US007278958B2

(12) United States Patent
Morgan

(10) Patent No.: US 7,278,958 B2
(45) Date of Patent: Oct. 9, 2007

(54) AUTOMATIC VARIABLE RESISTANCE EXERCISE SYSTEM

(76) Inventor: Curtis Wayne Morgan, 16826 Blanton, #4, Huntingtron Beach, CA (US) 92647

( * ) Notice: Subject to any disclaimer, the term of this patent is extended or adjusted under 35 U.S.C. 154(b) by 256 days.

(21) Appl. No.: 10/833,631

(22) Filed: Apr. 26, 2004

(65) Prior Publication Data

US 2004/0254050 A1 Dec. 16, 2004

Related U.S. Application Data

(60) Provisional application No. 60/478,337, filed on Jun. 16, 2003.

(51) Int. Cl.
*A63B 21/08* (2006.01)
*A63B 21/06* (2006.01)

(52) U.S. Cl. ..... 482/97; 482/93; 482/99; 482/121; 482/139

(58) Field of Classification Search ..... 482/92, 482/93, 97, 139, 94, 99, 135
See application file for complete search history.

(56) References Cited

U.S. PATENT DOCUMENTS 3,638,941 A * 2/1972 Kulkens ..... 482/113
4,650,185 A * 3/1987 Cartwright ..... 482/97
5,039,089 A * 8/1991 Lapcevic ..... 482/97
5,230,680 A * 7/1993 Wu ..... 482/97
5,316,534 A * 5/1994 Dalebout et al. ..... 482/133
5,344,374 A 9/1994 Telle
5,348,524 A * 9/1994 Grant ..... 482/130
5,435,798 A * 7/1995 Habing et al. ..... 482/5
5,624,353 A 4/1997 Naidus
5,643,151 A * 7/1997 Naimo ..... 482/98
6,685,607 B1 * 2/2004 Olson ..... 482/142
2004/0185988 A1 * 9/2004 Hsiung et al. ..... 482/102

* cited by examiner

*Primary Examiner*—Stephen R. Crow
*Assistant Examiner*—Allana Lewin
(74) *Attorney, Agent, or Firm*—Ruth Eure

(57) ABSTRACT

A variable resistance physical exercise apparatus is provided which provides improved features over prior art devices in that it is more compact, provides a linear resistance profile to the user and provides a variety of modes of operation. The device comprises a motor driven bi-directional linear translation mechanism to vary the effective length of a lever arm and therefore vary the weight of resistance to the user. An alternative embodiment includes a spring winder drum pulley combination.

1 Claim, 3 Drawing Sheets

AUTOMATIC VARIABLE RESISTANCE EXERCISE SYSTEM

CLAIM OF PRIORITY

This application claims priority under 35 USC Section 119(e) from U.S., Provisional Patent Application Ser. No. 60/478,337, filed Jun. 16, 2003.

FIELD OF THE INVENTION

This invention relates to physical exercise equipment.

BACKGROUND OF THE INVENTION

In the United States over 20 million people are engaged in the pursuit of physical exercise and/or physical therapy. These exercises fall into two general categories, aerobic exercise and strength conditioning. Many strength exercise routines require that the resistance to exercise be changed at various times. In most instances this requires the user to stop exercising and engage in some selection process to manually adjust a mechanical setting to change resistance parameters (such as inserting a pin to select a specific number of weight plates, adding or subtracting elastic devices, turning a knob which varies pneumatic or hydraulic resistance, etc).

U.S. Pat. No. 4,650,185 to Cartwright describes an exercise machine which attempts to provide a solution to this problem. The Cartwright device provides a beam pivoted off center with a weight movable along the beam under control of a motor. The drawback of this device is that the range of motion of the lever is only 90 degrees and in order to traverse a 40 inch span of travel, the length of the lever required would be four feet. This requires more space to operate than is acceptable in most home or gym settings.

Another attempt to solve this problem is described in U.S. Pat. No. 5,624,353 to Naidus. Naidus describes a weight training machine which comprises a variable resistance capability. However, this device requires the use of two sources of resistance to provide the variability of the resistance and the primary force must be manually selected.

U.S. Pat. No. 5,344,374 to Telle describes another variable resistance exercise machine. Telles device includes the combination of a pivotally mounted linear actuator and a dampener member, both of which are adjustable. Telle's device, like Cartwright's is unwieldy and impractically large and space consuming.

SUMMARY OF THE INVENTION

The present invention provides substantial improvements in these systems by providing the following advantages: (1) the ability to adjust the physical resistance or other parameters while the exercise is in progress, without interrupting the exercise, and (2) the ability to adjust the resistance continuously instead of in discrete steps over the entire resistance range, and (3) the ability of the system to adjust the resistance automatically based on a specific program or in response to user activity (such as efficiency, speed of activity, heart rate, etc.) and (4) the ability of the system to monitor and display various data regarding the user's activity (number of repetitions, stroke length, total work, total calories, etc.). In addition the improved system of the present invention provides user interaction via a touch screen display and keyboard allowing the user to set up and control the machine and select session by session settings or programs interactively.

The present invention provides these improvements by creating a general purpose, motorized, variable mechanical advantage block that may be inserted between an exercising user and a fixed resistance element. In existing systems, the resistance to exercise is set by selecting some number of weights, elastic bands, or flexible rods or adjusting some other element such as hydraulic or pneumatic components which set the resistance to the desired amount. The present invention takes a novel approach starting with the maximum weight that must be lifted or force that would be exercised against and then interposes a variable mechanical advantage between the user and that force or weight. As a result, as the mechanical advantage is varied, the user will experience a variable resistance in proportion to the advantage ratio. In other words, the resistance to exercise is the maximum amount to be experienced and the variable mechanical advantage allows the user to experience some percentage of that maximum resistance. If the mechanical advantage is 1 to 1, the maximum resistance will be experienced. If the advantage is 100 to 1 a resistance of $1/100^{th}$ of the fixed resistance will be experienced. In this way, the user can exercise or lift the entire fixed resistance or any lesser portion of it, in much the same way a person can lift an entire automobile by using the mechanical advantage of a jack. Because the variable mechanical advantage device is motor controlled, the user can easily vary the resistance to exercise, or the system can automatically vary the resistance to exercise, presenting the user with various exercise profiles, or altering the resistance in response to user activity without requiring the user to interrupt exercise activity. In addition, this system is applicable to many different forms of exercise resistance. It will function with weights, springs, flexible rods, or any other type of linear or non-linear resistance.

DETAILED DESCRIPTION OF THE INVENTION

The invention described here is a general purpose exercise, physical therapy, conditioning, and testing device in which the resistance to work being performed, the total work to be performed, and other such exercise parameters are variable and programmable. The system can alter these variables at any time during, before, or after an exercise without interruption of the exercise by the user. These alterations can be made according to fixed pre-programmed values or in response to user activity, such as speed of movement, fatigue level, or number of repetitions performed, for example, or randomly, if desired. These alterations may also be controlled manually by the user before, during, or after exercise.

The alteration of these parameters is accomplished by the introduction of a motor controlled variable mechanical advantage mechanism between the user and some form of fixed resistance to motion. The fixed resistance to motion may be a weight, spring, flexible rod, elastic band or any such device that presents a fixed resistance to motion. The exercising user actuates the fixed resistance using the variable mechanical advantage device so all or any portion of the fixed resistance to motion is experienced, based on the setting of the variable mechanical advantage. The motor-driven variable mechanical advantage device is controlled by a microprocessor control system that provides manual or automatic variations in user resistance, and provides user interface, data recording and display.

Figure 1:
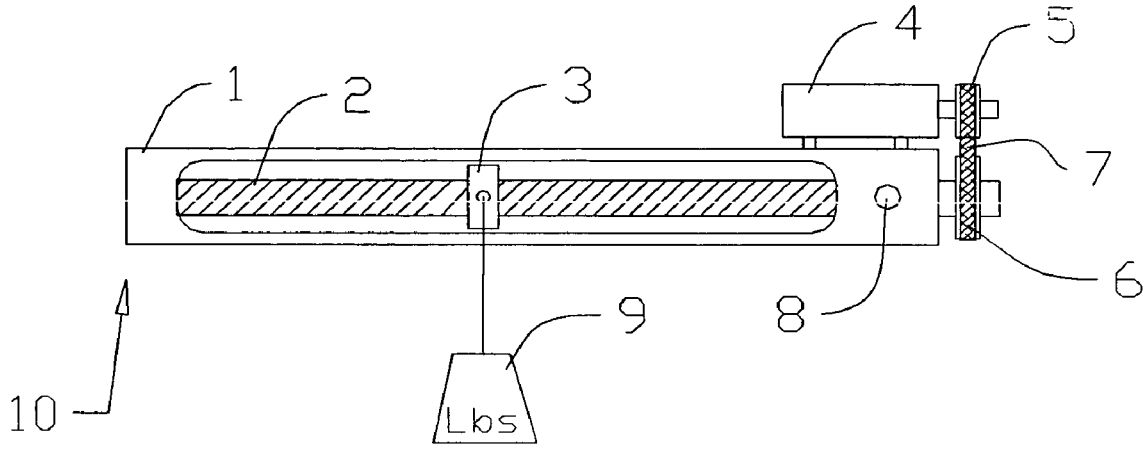
FIG. 1 is a side view of the primary element of the variable mechanical advantage device of the present invention.

FIG. 1 shows the primary element of this variable mechanical advantage device which constitutes a lever, which houses a motor driven movable attachment point. The mechanical advantage of this device is varied by causing this attachment point to move from one end of the lever to the other. More specifically, the elements include: a box channel 1; housing a threaded lead screw 2; a movable lead screw nut 3; a reversible motor 4; a motor pulley 5; a lead screw shaft pulley 6; a pulley belt 7; a pivot point on the box channel 8; a form of fixed resistance 9 (such as weight, or spring); and a point of user applied force 10. The combination of these components makes in essence an adjustable variable length lever. The box channel 1 houses a bearing-mounted rotating, threaded lead screw 2. A lead screw nut 3 will move back and forth on the lead screw 2 when the lead screw 2 is rotated. An attachment point on the lead screw nut 3 forms the attachment point for the fixed resistance 9. The motor 4 may rotate the lead screw 2 via the pulleys 5, 6 and belt 7, and thus cause the nut 3 to move back and forth. The entire mechanism is mounted at pivot point 8 so that the entire device can rotate around the pivot point 8 and swing up and down. In this example, the exercising user applies force at location 10 on the box channel 1 to lift the non-attached end of the box channel 1 (lever). In so doing, the weight 9 (or spring) attached to movable nut 3 will be lifted (or stretched). If the moving nut 3 is positioned close to lifting point 10, then the entire weight will be lifted. If the moving nut 3 is positioned close to pivot point 8 then only a very small fraction of the weight 9 will be lifted. Moving nut positions between these two extremes will produce an appropriate proportional resistance. In this manner the user can work against any portion of, or the entire fixed resistance amount. Since the control system controls and keeps track of the nut position, it can calculate the force being worked against, total work, calories and numerous other exercise parameters.

Figure 2:
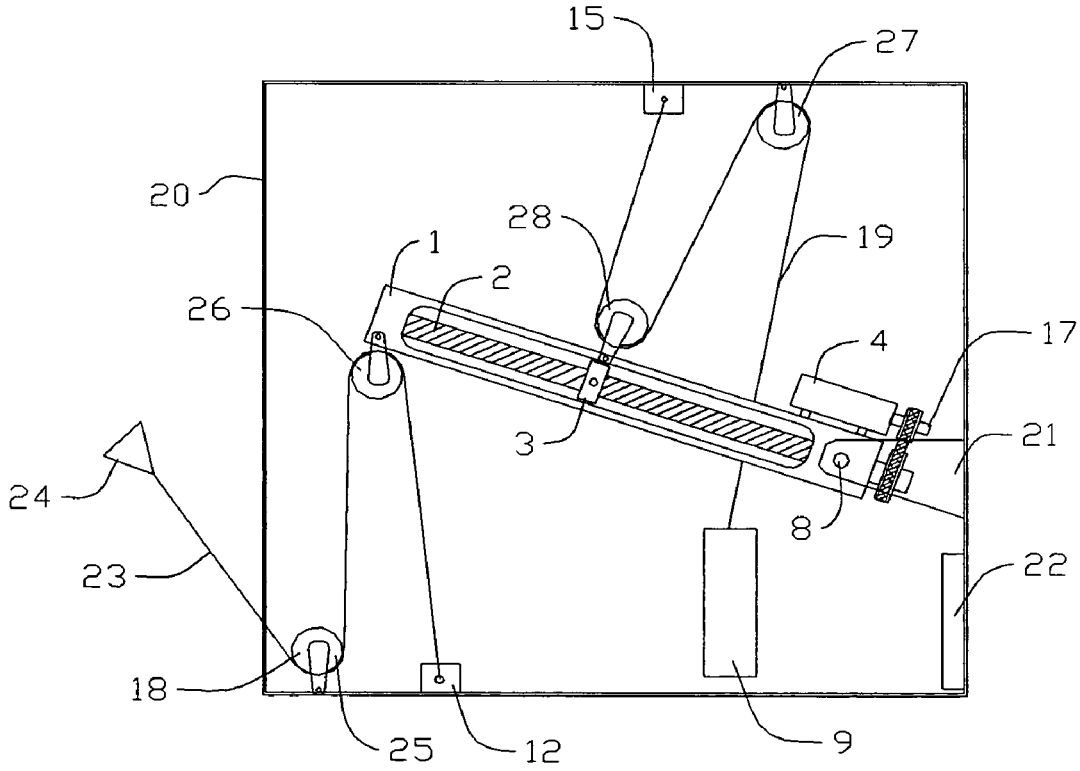
FIG. 2 shows an embodiment of this device in which the element of FIG. 1 is mounted in a box frame and includes an integral reduction and expansion pulley system.

FIG. 2 illustrates the preferred embodiment of the variable mechanical advantage device as would be used in an exercise system. It is composed of Box Frame 20; the previously described variable mechanical advantage (VMA) lever housed in box channel 1; the movable nut 3; the lever pivot point 8; the mounting bracket 21; the reversible motor 4; motor drive electronics 22; the user cable 23; the user handle 24; reduction and expansion pulleys 25, 26, 27 28; the cable attachment point 12, 15; the fixed resistance 9 (weight or spring); digital encoders 17, 18; and resistance cable 19. This system provides a method of mounting the VMA lever and provides for increased lever efficiency and size reduction.

The pulley system enhances operation by providing convenient input and output attachment points but more importantly, a reduced lever size.

Many exercises require a range of motion of 36 inches or more. In order to properly actuate the fixed resistance the VMA lever arc should not exceed the range of 90 degrees. To meet both these requirements would require an impractical lever length of three to four feet or more. This lever size would be expensive, cumbersome and spatially inefficient. By using the mounting and reduction and expansion pulley system of FIG. 2, the lever motion is reduced 2:1, thereby allowing the reduction of lever length to a more acceptable level. In operation, the user pulls up on handle 24 which routes under pulley 25 and over pulley 26. The net result is that for every inch the handle 24 is pulled up, the end of the VMA lever moves down half that distance. A cable 19 connected to a weight or spring 9 is routed over pulley 27 and under pulley 28 to fixed attachment 15. As a result, for every inch the moving nut 3 and pulley 28 move down, the weight moves up or the spring expands twice that distance. As a result in the overall system, when the VMA lever is set to a ratio of 1:1 (nut at the user end of the lever) the weight or spring attachment will move one inch of every one inch of user pull travel, however the lever arm will only travel half that distance. This "reduction in—expansion out" pulley system results in a shorter VMA lever, more spatially efficient, lower cost device. Digital feedback encoders 17 and 18 monitor user motion and lead screw 2 position and allow the control system to control resistance setting and record data of user range of motion, number of repetitions, total work completed, etc.

Figure 3:
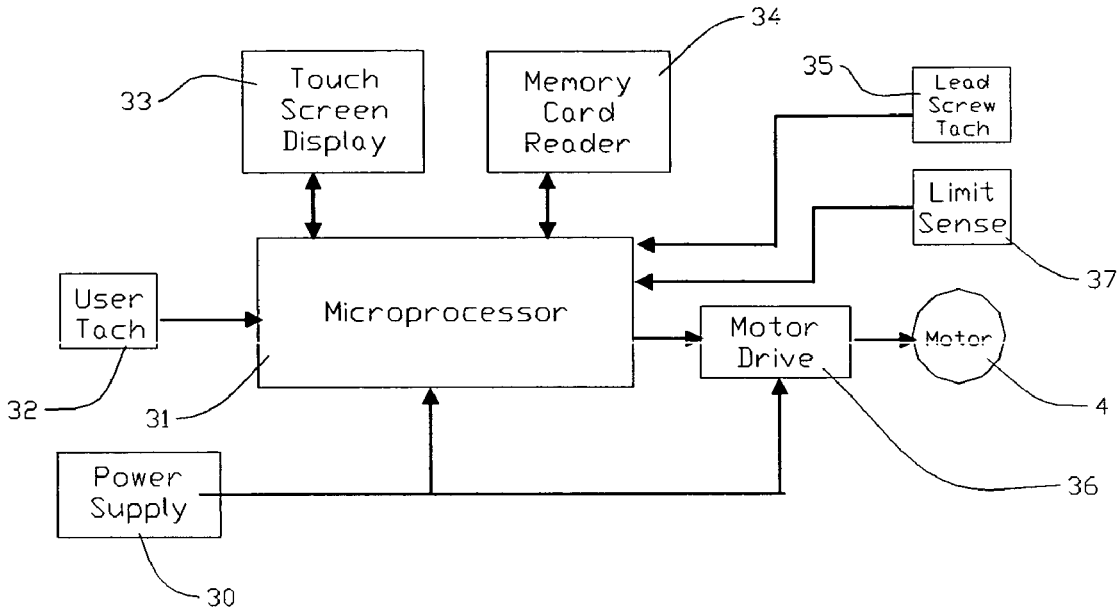
FIG. 3 is a block diagram illustration of a proposed microprocessor control system.

FIG. 3 is a block diagram illustration of a proposed microprocessor control system. It includes a power supply 30; a microprocessor or microcontroller 31; a user movement digital encoder 32; an interactive touch screen display 33; a memory card read/write interface 34; a lead screw movement digital encoder 35; motor drive circuitry 36; reversible motor 4; and nut travel limit sensors 37. The power supply 30 provides power to all circuitry elements. The microprocessor 31 oversees all monitoring, motor control, and user interface. A user digital encoder 32 monitors user pulley rotation and thus user stroke length and speed and is an input to the microprocessor 31. A touch screen display 33 interfaces to the microprocessor 31 and provides display of data and messages and input of user selections via the touch screen 33. The memory card reader 34 interfaces to the microprocessor 31 and a plug in personal memory card (not shown) that can store and recall workout data, specific protocols, screen images, etc. A lead screw position encoder 35 provides lead screw position information to the microprocessor 31 for motor 4 control feedback. Reversible motor 4 is controlled via the microprocessor 31 and motor drive circuitry 36 and thus rotates the lead screw 2 to position the lead screw nut 3 and thus vary mechanical advantage. Limit sense devices 37 provide end of travel information to the microprocessor 31 and thus effect safety end of travel shut down and recovery.

In use, the user selects profiles or exercise specifics from the touch screen display 33 and then executes exercises either self-guided or guided by information from the display. During and after the activity, exercise data is displayed and recorded for summary recall and recall at a later time.

Figure 4:
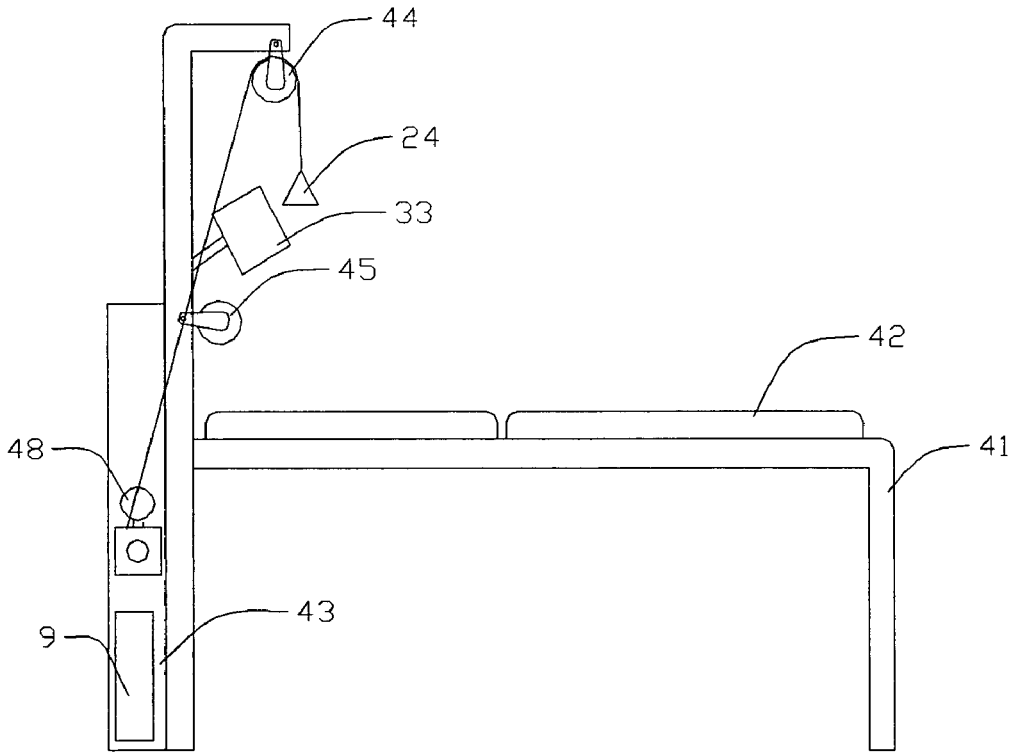
FIG. 4 illustrates an overall integrated multi-purpose exercise system.

FIG. 4 illustrates the integration of the variable mechanical advantage device into a multi-purpose exercise device. This includes a physical metal apparatus frame 41; user seat cushions 42; the variable mechanical advantage device 43 enclosing motor lead screw combination 48 and resistance 9; various routing pulleys 44, 45; cable handle 24; user touch screen display interface 33. This allows the user to sit or lie on the support cushions 42, operate the machine via touch screen 33, and perform various exercises via pulleys 44,45 and handle 24. During operation the system will present various resistance loads to the user via the motor lead screw combination 48 and fixed resistance 9.

Figure 5:
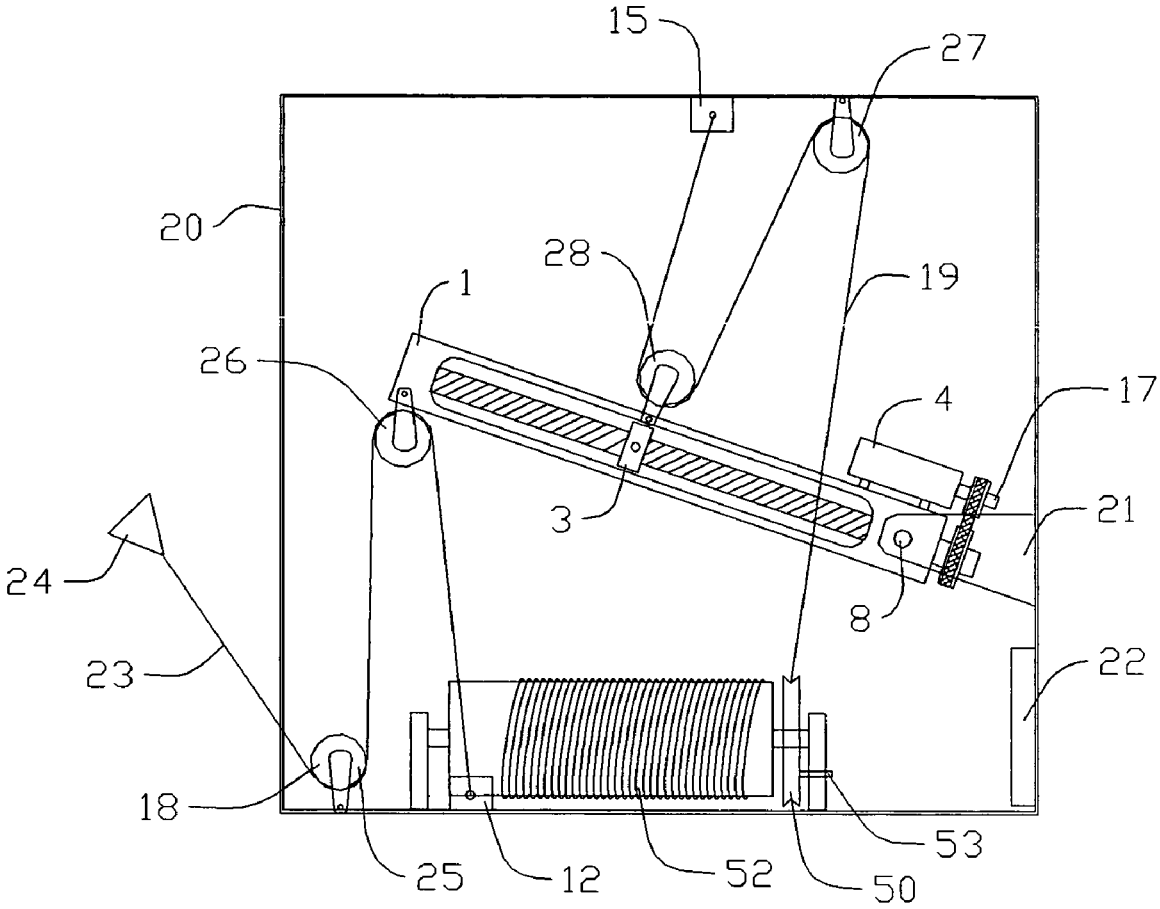
FIG. 5 shows a preferred embodiment of the present invention.

FIG. 5 illustrates a preferred embodiment of the present invention. Most strength exercise devices provide for resistance adjustment by allowing for the addition or subtraction of some number of incremental resistances (a stack of weight plates, a group of flexible rods, etc.). To adjust the force or resistance the user connects together some number of these weight plates or flexible rods to form the final user resistance. Weight plates take less space than flexible rods but are heavy, making the equipment less mobile and expensive to transport. Flexible rods on the other hand are not heavy but require more space in which to operate, have a limited range of motion, and provide an undesirable progressive resistance profile which increases throughout the stroke range.

Since the automatic variable resistance exercise system described herein places a variable mechanical advantage device between the user and the resistance force it will function with existing conventional weights, flexible rods, or any other resistance currently used in existing exercise equipment. However, since adjustment of the resistance force is via the variable mechanical advantage mechanism, the system always actuates the maximum resistance force and thus no longer requires that the force (weight, rods, etc.) be incrementally combined. As a result, other forms of resistance force generation become viable.

FIG. 5 illustrates one such preferred resistance force. The force in this diagram is created by a spring-winder-drum-pulley combination. As the user operates the machine by pulling on handle 24 the force is transmitted through the variable mechanical advantage to cable 19 and pulley 50 causing pulley 50 to rotate as the cable 19 is unwound. This rotation causes spring 52 to "wind up" thus creating resistance to motion as the spring 52 compresses. Additionally this spring 52 is of such a size that it is capable of many more turns of motion than the one or two turns of actuation caused by the cable system. In practice, the spring drum is pre-wound several turns and held in this pre-tensioned condition by a stop pin 53. As a result the cable 19 acts against a spring 52 that is already at 80% to 90% of its tension range. Since the cable action only consumes the last 10% to 20% of the spring range it experiences an immediate and nearly linear force. As a result this spring-drum-winder provides this exercise device with a force which is space efficient, weight efficient, immediate, and nearly linear. All of these are desirable characteristics. While this embodiment is shown with a lever, which swings up and down, other orientations are possible in which the lever moves in other directions such as side to side from a fixed point like a pendulum. Also since the spring drum winder is not gravity dependent, it may also be located in other orientations. The spring drum winder may also be useful in non-gravity situations such as on a space station.

Another alternative embodiment of the present invention comprises a linear translation mechanism having a box channel housing a movable rolling assembly operated via a chain drive mechanism with sprockets at either end of the channel. A sprocket on one end of the channel is coupled to a reversible motor gear box assembly.

Another alternative embodiment would incorporate the variable resistance exercise device described above in its various embodiments into an existing machine by inserting the device between the user and the resistance force.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A physical exercise apparatus for use by a user comprising:

a) a box frame wherein the box frame contains the components and provides spatial stability;

b) a resistance force providing a resistance to exercise motion;

wherein the resistance force is comprised of a spring drum winder in which the spring is wound and tensioned as the user pulls on one or more cable handles and the spring winder is pre-wound or tensioned so that it presents an immediate and linear force to the user;

c) a linear translation mechanism forming a variable length lever having a pivot point, wherein said lever can be adjusted in length to create an adjustable distance between the pivot point and the resistance attachment point, wherein said lever is a movable element, and wherein the linear translation mechanism forming a variable length lever having a first end and a second end and pivots at or near the first end and is motor driven and is bi-directional;

d) a reduction cable pulley system to reduce the required length of the lever and the lever travel distance; wherein the reduction cable pulley system provides the lever range of motion to be reduced by one half or more of the user range of motion when actuated by the user;

e) an expansion cable pulley system; wherein the expansion cable pulley system cable having a first end and a second end wherein the first end is attached to the movable element of the linear translation mechanism and the second end is attached to the resistance force to cause force actuation;

f) a computer control display system; wherein the computer control display system is affixed to or adjacent to the box frame and monitors feedback signals from the components and affects motor movement to cause position change of the linear translation mechanism resulting in varying the resistance force presented to the user; and g) at least one handle on at least one cable.

* * * * *